US008161929B2

(12) United States Patent
Kuhl et al.

(10) Patent No.: US 8,161,929 B2
(45) Date of Patent: Apr. 24, 2012

(54) SWITCHABLE TAPPET

(75) Inventors: Mario Kuhl, Herzogenaurach (DE); Lothar von Schimonsky, Gerhardshofen (DE); Norbert Nitz, Erlangen (DE); Lucia Hinkovska, Herzogenaurach (DE); Sandra Schäfer, Höchstadt (DE)

(73) Assignee: Schaeffler KG, Herzogenaurach (DE)

( * ) Notice: Subject to any disclaimer, the term of this patent is extended or adjusted under 35 U.S.C. 154(b) by 426 days.

(21) Appl. No.: 12/274,052

(22) Filed: Nov. 19, 2008

(65) Prior Publication Data

US 2009/0159029 A1 Jun. 25, 2009

Related U.S. Application Data

(60) Provisional application No. 60/989,543, filed on Nov. 21, 2007, provisional application No. 61/017,035, filed on Dec. 27, 2007.

(51) Int. Cl.
*F01L 1/14* (2006.01)

(52) U.S. Cl. ..... 123/90.48; 123/90.16

(58) Field of Classification Search ..... 123/90.48, 123/90.5, 90.52, 90.16
See application file for complete search history.

(56) References Cited

U.S. PATENT DOCUMENTS

| | | | | |
|---|---|---|---|---|
| 3,108,580 | A | 10/1963 | Crane | |
| 3,886,808 | A | 6/1975 | Weber | 74/569 |
| 4,054,109 | A | 10/1977 | Herrin et al. | 123/90.16 |
| 4,083,334 | A | 4/1978 | Roncon | 123/90.35 |

(Continued)

FOREIGN PATENT DOCUMENTS

DE 42 06 166 A1 9/1992

(Continued)

OTHER PUBLICATIONS

Fortnagel, M. et al., Four Made of Eight—The New 4.31 and 5.01 V8 Engines, Mercedes-Benz S-Class, pp. 58-63 (1997).
Sandford, M. et al., "Reduced Fuel Consumption and Emission Through Cylinder Deactivation", Aachener Kolloquium Fahrzeug- und Motorentechnik, pp. 1016-1027 (1998).

(Continued)

*Primary Examiner* — Zelalem Eshete
(74) *Attorney, Agent, or Firm* — Fitzpatrick, Cella, Harper & Scinto

(57) ABSTRACT

The invention proposes a switchable tappet (1) of a valve train of an internal combustion engine, said tappet comprising a hollow cylindrical housing (3) comprising a bottom (2), an inner element (5) being guided for relative axial displacement in a bore (4) of the housing (3), an at least indirect support for a gas exchange valve extending on a cam-distal front end (6) of the inner element (5), two diametrically opposing pistons as coupling elements (8) being arranged in a radial bore (7) of the inner element (5), which coupling elements (8), for effecting coupling [full valve lift], can be displaced partly beyond a parting surface (9) between the housing (3) and the inner element (5) into an entraining surface (12) of the housing (3) by the force of a compression spring (10*a*) clamped between inner front ends (10) of the coupling elements (8), wherein the entraining surface (12) is an direct constituent of a separate annular member (13) that is fixed in a cam-distal region of the bore (4) of the housing (3), wherein only one compression spring as a lost motion spring means (16) extends in a cylindrical hollow space (15) formed between an underside (14) of the bottom (2) of the housing (3) and a cam-side flat front end (14*a*) of the inner element (5), and wherein the inner element (5) is substantially disk-shaped and the parting surface (9) between the housing (3) and the inner element (5) does not comprise any vertical stop means.

16 Claims, 1 Drawing Sheet

U.S. PATENT DOCUMENTS

| | | | | |
|---|---|---|---|---|
| 4,089,234 | A | 5/1978 | Henson et al. | 74/569 |
| 4,098,240 | A | 7/1978 | Abell | 123/90.55 |
| 4,133,332 | A | 1/1979 | Benson et al. | 123/198 F |
| 4,164,917 | A | 8/1979 | Glasson | 123/97 |
| 4,207,775 | A | 6/1980 | Lintott | 74/55 |
| 4,228,771 | A | 10/1980 | Krieg | 123/90.55 |
| 4,231,267 | A | 11/1980 | Van Slooten | 74/569 |
| 4,386,806 | A | 6/1983 | Axen et al. | 299/5 |
| 4,463,714 | A | 8/1984 | Nakamura | 123/90.57 |
| 4,546,734 | A | 10/1985 | Kodama | 123/90.16 |
| 4,576,128 | A | 3/1986 | Kenichi | 123/198 |
| 4,615,307 | A | 10/1986 | Kodama et al. | 123/90.16 |
| 4,739,675 | A | 4/1988 | Connell | 74/569 |
| 4,768,475 | A | 9/1988 | Ikemura | 123/90.16 |
| 4,790,274 | A | 12/1988 | Inoue et al. | 123/198 F |
| 4,905,639 | A | 3/1990 | Konno | 123/90.16 |
| 4,913,106 | A | 4/1990 | Rhoads | 123/90.49 |
| 4,941,438 | A | 7/1990 | Muto | 123/90.46 |
| 4,942,855 | A | 7/1990 | Muto | 123/90.33 |
| 5,085,182 | A | 2/1992 | Nakamura et al. | 123/90.16 |
| 5,088,455 | A | 2/1992 | Moretz | 123/90.5 |
| 5,090,364 | A | 2/1992 | McCarroll et al. | 123/90.16 |
| 5,099,806 | A | 3/1992 | Murata et al. | 123/90.16 |
| 5,245,958 | A | 9/1993 | Krieg et al. | 123/90.55 |
| 5,247,913 | A | 9/1993 | Manolis | 123/90.16 |
| 5,253,621 | A | 10/1993 | Dopson et al. | 123/90.16 |
| 5,255,639 | A | 10/1993 | Shirey et al. | 123/90.16 |
| 5,261,361 | A | 11/1993 | Speil | 123/90.22 |
| 5,307,769 | A | 5/1994 | Meagher et al. | 123/90.5 |
| 5,345,904 | A | 9/1994 | Dopson et al. | 123/198 F |
| 5,351,662 | A | 10/1994 | Dopson et al. | 123/90.16 |
| 5,357,916 | A | 10/1994 | Matterazzo | 123/90.16 |
| 5,361,733 | A | 11/1994 | Spath et al. | 123/90.16 |
| 5,398,648 | A | 3/1995 | Spath et al. | 123/90.16 |
| 5,402,756 | A | 4/1995 | Bohme et al. | 123/90.16 |
| 5,419,290 | A | 5/1995 | Hurr et al. | 123/90.16 |
| 5,429,079 | A | 7/1995 | Murata et al. | 123/90.16 |
| 5,431,133 | A | 7/1995 | Spath et al. | 123/90.16 |
| 5,501,186 | A | 3/1996 | Hara et al. | 123/90.16 |
| 5,544,626 | A | 8/1996 | Diggs et al. | 123/90.16 |
| 5,544,628 | A | 8/1996 | Voigt | 123/90.16 |
| 5,546,899 | A | 8/1996 | Sperling et al. | 123/90.5 |
| 5,555,861 | A | 9/1996 | Mayr et al. | 123/90.16 |
| 5,615,651 | A | 4/1997 | Miyachi | 123/198 F |
| 5,651,335 | A | 7/1997 | Elendt et al. | 123/90.16 |
| 5,655,487 | A | 8/1997 | Maas et al. | 123/90.16 |
| 5,660,153 | A | 8/1997 | Hampton et al. | 123/90.16 |
| 5,669,342 | A | 9/1997 | Speil | 123/90.16 |
| 5,682,848 | A | 11/1997 | Hampton et al. | 123/90.16 |
| 5,709,180 | A | 1/1998 | Spath | 123/90.16 |
| 5,720,244 | A | 2/1998 | Faria | 123/90.16 |
| 5,782,216 | A | 7/1998 | Haas et al. | 123/90.16 |
| 5,803,040 | A | 9/1998 | Biesinger et al. | 123/198 F |
| 5,832,884 | A | 11/1998 | Haas et al. | 123/90.16 |
| 5,875,748 | A | 3/1999 | Haas et al. | 123/90.16 |
| 5,893,344 | A | 4/1999 | Church | 123/90.16 |
| 5,934,232 | A | 8/1999 | Greene et al. | 123/90.16 |
| 6,032,643 | A | 3/2000 | Hosaka et al. | 123/321 |
| 6,039,017 | A | 3/2000 | Hendriksma | 123/90.43 |
| 6,053,133 | A | 4/2000 | Faria et al. | 123/90.16 |
| 6,076,491 | A | 6/2000 | Allen | 123/90.16 |
| 6,092,497 | A | 7/2000 | Preston et al. | 123/90.16 |
| 6,095,696 | A | 8/2000 | Földi | 385/79 |
| 6,164,255 | A | 12/2000 | Maas et al. | 123/90.16 |
| 6,196,175 | B1 | 3/2001 | Church | 123/90.16 |
| 6,196,176 | B1 | 3/2001 | Groh et al. | 123/90.16 |
| 6,213,076 | B1 | 4/2001 | Fischer et al. | 123/90.55 |
| 6,244,229 | B1 | 6/2001 | Nakano et al. | 123/90.15 |
| 6,247,433 | B1 | 6/2001 | Faria et al. | 123/90.16 |
| 6,257,185 | B1 | 7/2001 | Groh et al. | 123/90.16 |
| 6,273,039 | B1 | 8/2001 | Church | 123/90.16 |
| 6,318,324 | B1 | 11/2001 | Koeroghlian et al. | 123/90.55 |
| 6,321,704 | B1 | 11/2001 | Church et al. | 123/90.16 |
| 6,321,705 | B1 | 11/2001 | Fernandez et al. | 123/90.16 |
| 6,325,030 | B1 | 12/2001 | Spath et al. | 123/90.16 |
| 6,345,596 | B1 | 2/2002 | Kuhl | 123/90.16 |
| 6,405,699 | B1 | 6/2002 | Church | 123/90.5 |
| 6,412,460 | B1 | 7/2002 | Sato et al. | 123/90.16 |
| 6,427,652 | B2 | 8/2002 | Faria et al. | 123/90.16 |
| 6,439,176 | B1 | 8/2002 | Payne et al. | 123/90.12 |
| 6,460,499 | B1 | 10/2002 | Mason et al. | 123/90.55 |
| 6,477,997 | B1 | 11/2002 | Wakeman | 123/90.16 |
| 6,497,207 | B2 | 12/2002 | Spath et al. | 123/90.16 |
| 6,513,470 | B1 | 2/2003 | Hendriksma et al. | 123/90.16 |
| 6,520,135 | B2 * | 2/2003 | Sugawara | 123/90.48 |
| 6,578,535 | B2 | 6/2003 | Spath et al. | 123/90.16 |
| 6,588,394 | B2 | 7/2003 | Zheng | 123/198 F |
| 6,591,796 | B1 | 7/2003 | Scott | 123/90.13 |
| 6,595,174 | B2 | 7/2003 | Schnell | 123/90.55 |
| 6,606,972 | B2 | 8/2003 | Wenisch et al. | 123/90.17 |
| 6,615,783 | B2 | 9/2003 | Haas et al. | 123/90.48 |
| 6,655,487 | B2 | 12/2003 | Mallette et al. | 180/190 |
| 6,668,776 | B2 | 12/2003 | Hendriksma et al. | 123/90.16 |
| 6,745,737 | B2 | 6/2004 | Evans et al. | 123/90.5 |
| 6,748,914 | B2 | 6/2004 | Spath et al. | 123/90.53 |
| 6,802,288 | B2 | 10/2004 | Spath | 123/90.16 |
| 6,814,040 | B2 | 11/2004 | Hendriksma et al. | 123/90.59 |
| 6,866,014 | B2 | 3/2005 | Spath | 123/90.5 |
| 6,920,857 | B2 | 7/2005 | Spath | 123/90.48 |
| 6,976,463 | B2 | 12/2005 | Spath et al. | 123/90.59 |
| 6,977,154 | B1 | 12/2005 | Choo et al. | 435/7.1 |
| 6,997,154 | B2 | 2/2006 | Geyer et al. | 123/90.44 |
| 7,007,651 | B2 | 3/2006 | Spath | 123/90.5 |
| 7,036,481 | B2 | 5/2006 | Sailer et al. | 123/198 F |
| 7,055,479 | B2 | 6/2006 | Sailer et al. | 123/90.59 |
| 7,146,951 | B2 | 12/2006 | Sailer et al. | 123/90.45 |
| 7,207,303 | B2 | 4/2007 | Geyer et al. | 123/90.55 |
| 7,210,439 | B2 | 5/2007 | Geyer et al. | 123/90.55 |
| 7,246,587 | B2 | 7/2007 | Evans et al. | 123/90.52 |
| 7,464,680 | B2 | 12/2008 | Geyer et al. | 123/90.59 |
| 2001/0009145 | A1 | 7/2001 | Faria et al. | 123/90.16 |
| 2001/0027766 | A1 * | 10/2001 | Speil | 123/90.48 |
| 2002/0038642 | A1 | 4/2002 | Haas et al. | 123/90.48 |
| 2002/0195072 | A1 | 12/2002 | Spath et al. | 123/90.16 |
| 2003/0070636 | A1 | 4/2003 | Evans et al. | 123/90.5 |
| 2003/0075129 | A1 | 4/2003 | Spath et al. | 123/90.16 |
| 2003/0101953 | A1 | 6/2003 | Hendriksma et al. | 123/90.16 |
| 2005/0005884 | A1 | 1/2005 | Geyer et al. | 123/90.16 |
| 2005/0081811 | A1 | 4/2005 | Spath et al. | 123/90.48 |
| 2005/0103300 | A1 | 5/2005 | Spath et al. | 123/90.59 |
| 2005/0120989 | A1 | 6/2005 | Geyer et al. | 123/90.59 |
| 2006/0191503 | A1 | 8/2006 | Geyer et al. | 123/90.15 |
| 2006/0225682 | A1 | 10/2006 | Evans et al. | 123/90.59 |

FOREIGN PATENT DOCUMENTS

| | | | |
|---|---|---|---|
| DE | 43 32 660 | A1 | 3/1995 |
| DE | 43 33 927 | A1 | 4/1995 |
| DE | 195 02 332 | A1 | 8/1996 |
| DE | 198 04 952 | A1 | 8/1999 |
| DE | 198 44 202 | A1 | 3/2000 |
| DE | 199 15 531 | A1 | 10/2000 |
| DE | 199 15 532 | A1 | 10/2000 |
| DE | 199 19 245 | A1 | 11/2000 |
| EP | 0 318 151 | A1 | 5/1989 |
| EP | 0 608 925 | B1 | 8/1996 |
| EP | 1 149 989 | A1 | 10/2001 |
| GB | 574 852 | A | 1/1946 |
| GB | 2 272 022 | | 5/1994 |
| WO | WO 9530081 | A1 | 11/1995 |

OTHER PUBLICATIONS

Chrysler Group, "Design Practice Standards", Paper dated Mar. 15, 2005, 1 page, in German with English Translation (2 pages).

Quan Zheng, "Characterization of the Dynamic Response of a Cylinder Deactivation Valvetrain System" Society of Automotive Engineers, Inc. SAE Technical Paper Series, Mar. 2001, pp. 195-201.

K. Hampton, Eaton VRRS System, Society of Automotive Engineers, Inc., Variable Value Actuation TOPTEC®: The State of the Art, Sep. 11-12, 2000, 14 pages.

Buuck, B. et al., "Engine Trends and Valve Train Systems for Improved Performance and Fuel Economy", Eaton Corporation—Engine Components Operations, USA, pp. 1-9 (Aug. 1999).

O. Schnell, "DaimlerChrysler 5.7L MDS Lifter", (on or about) Jan. 29, 2001, pp. 1-7.

* cited by examiner

SWITCHABLE TAPPET

This application claims the benefit under 35 U.S.C. 119(e) of U.S. Provisional Application Nos. 60/989,543, filed Nov. 21, 2007 and 61/017,035, filed Dec. 27, 2007, each of which is hereby incorporated by reference in its entirety, as if set forth fully herein.

FIELD OF THE INVENTION

The invention concerns a switchable tappet, especially a cup tappet of a valve train of an internal combustion engine, said tappet comprising a hollow cylindrical housing comprising a bottom, an inner element being guided for relative axial displacement in a bore of the housing, an at least indirect support for a gas exchange valve extending on a cam-distal front end of the inner element, at least one coupling element extending completely in an uncoupled mode [0-valve lift] in a radial bore of the inner element, which coupling element, for effecting coupling [full valve lift], can be displaced partly beyond a parting surface between the housing and the inner element into an entraining surface of the housing by the force of at least one compression spring acting on an inner front end of the coupling element.

BACKGROUND OF THE INVENTION

Tappets of the pre-cited type are used in OHC or DOHC engines but they often do not meet requirements related to light-weight, simple construction and manufacturability. It is further noted that the coupling mechanism in prior art tappets is relatively complicated and that separate measures are implemented for adjusting coupling lash and valve lash.

OBJECTS OF THE INVENTION

It is an object of the present invention to provide a switchable mechanical tappet of the pre-cited type in which the aforesaid drawbacks are eliminated using simple measures.

These and other objects and advantages of the invention will become obvious from the following detailed description.

SUMMARY OF THE INVENTION

The invention achieves the above objects by the fact that the entraining surface is an direct constituent of a separate annular member that is fixed in a cam-distal region of the bore of the housing, wherein only one compression spring/only one stack of compression springs as a lost motion spring means extends in a cylindrical hollow space formed between an underside of the bottom of the housing and a cam-side flat front end of the inner element, and wherein the inner element is substantially disk-shaped and the parting surface between the housing and the inner element does not comprise any vertical stop means.

Thus, a switchable tappet is provided that eliminates the aforesaid drawbacks. The tappet is preferably, but not necessarily, configured without hydraulic lash adjustment. Although this tappet is particularly meant for OHC and DOHC valve trains, it is also conceivable to use it in a valve train with a 3-dimensional cam, as an injection pump tappet or as a tappet for a valve train with a bottom camshaft and tappet push rod.

The tappet of the present invention has a simple structure, requires relatively few components and is simple to manufacture. An important feature of the invention is that the entraining surface is arranged in or on a separate annular member that is, for instance, pressed into the bore of the housing or welded thereto. This means that the entraining surfaces can be applied and finished "externally", so that an implementation of complex measures on the housing skirt is not required.

The entraining surface is preferably configured as a window or the like. However, it is also conceivable and included in the invention to configure the entraining surface as an annular groove (or even an annular groove segment) in the separate annular member. This separate annular member imparts additional rigidity to the housing of the tappet, so that this, if necessary, can be made with thinner walls. With this measure, the oscillating valve train mass can be reduced.

Through the proposed omission of vertical stop means on the parting surface between the housing and the inner element or, more precisely, on the parting surface between the annular member extending fixedly in the housing and the inner element, the lost motion spring is arranged quasi directly on the spring of the gas exchange valve. The components of the tappet have only to be held together for transportation. In the course of adjustment of valve lash by the manufacturer, a required minimum locking lash is also set, so that, in other words, the locking lash corresponds to the valve lash.

The apertures arranged on the inner element according to another proposition of the invention not only reduce the mass of the inner element but also serve for "venting" the hollow space between the bottom of the housing and the inner element in the switched-off mode.

According to a particularly preferred feature of the invention, pistons or similar components as coupling elements are arranged diametrically opposite each other in the radial bore of the inner element. However, the invention also functions with only one piston or with a plurality of radially distributed elements.

A simple possibility for loading the pistons as coupling elements in their coupling direction is to use a compression spring that is quasi clamped between the inner front ends of the pistons. Thus, it is clear that the radial bore in the inner element is configured as a through-bore (or, if necessary, it is stepped for forming inner stops for the pistons). Where appropriate, the bore for each piston can also be configured as a pocket bore, in which case, each piston is loaded radially outwards by "its own" compression spring.

According to another advantageous development of the invention, it is proposed to provide the inner element with an anti-rotation device relative to the housing or, more precisely, relative to the separate annular member in the housing. An appropriate means for this is, for example, a pin or a simple rolling bearing ball that is fixed, for instance, in the outer peripheral surface of the inner element and extends in a complementary longitudinal groove on the inner peripheral surface of the annular member. Where appropriate, this anti-rotation body may also extend radially inwards from the annular member. In this way, an exact positional relationship between the pistons as coupling elements and the entraining surface is always guaranteed. If an annular groove is used as an entraining surface, the aforesaid anti-rotation device can (but must not) be dispensed with.

According to another particularly advantageous proposition of the invention, an upper side of the pistons comprises a flattened portion through which the pistons can be displaced into the corresponding entraining surface. Thus, in the coupled mode, the components are subjected only to a slight load.

According to still another proposition of the invention, the pistons are guided through an anti-rotation device in their bore in the inner element, so that displacement in the proper direction is always assured. This anti-rotation device can appropriately be constituted, for instance, by a simple insert such as a pin that extends from a region of the upper front end of the inner element through the radial bore onto the respective flattened portion.

According to still another feature of the invention, the tappet itself can be arranged for free rotation in its surrounding structure, which means that an "outer" anti-rotation feature is not provided on the tappet.

For the supply of hydraulic medium to the outer front ends of the coupling pistons, another feature of the invention proposes an annular groove in the outer peripheral surface of the housing, "behind" which annular groove, as viewed in flow direction, passages starting from this annular groove extend through the housing and the annular member for routing hydraulic medium into an annular groove in the outer peripheral surface of the inner element.

For always assuring a constant length of the hydraulic medium paths, the passages are advantageously arranged offset at 90° in the peripheral direction to the radial bore of the inner element.

It is further proposed to arrange in a central position, an opening leading out of the inner element for venting the radial bore of the inner element. In this way, a "pumping-up" of the pistons as coupling elements during their uncoupling movement is effectively prevented.

Finally, the invention proposes a simple fixing of the annular member in the bore of the housing. For instance, the housing can be pressed or welded into place. Alternatively, glued or snap connections may also be used.

BRIEF DESCRIPTION OF THE DRAWING

The invention will now be advantageously explained with reference to the appended drawings.

DETAILED DESCRIPTION OF THE DRAWING

Figure 1:
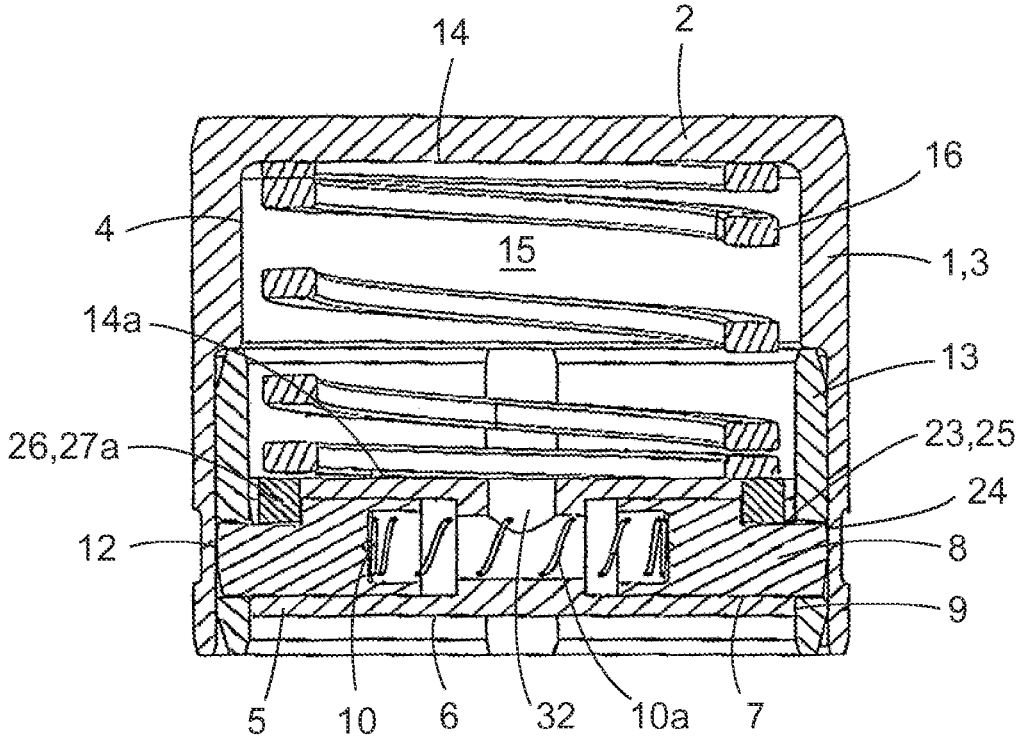
FIG. 1 shows a longitudinal section through a switchable tappet, in a region of coupling elements thereof.

The figures show a switchable tappet 1 for a valve train of an internal combustion engine, said switchable tappet 1 comprising a hollow cylindrical housing 3 that is closed at one end by a bottom 2. This bottom 2 serves as a contact surface for a lift cam and, if appropriate, this cam can be cylindrically vaulted in its excursion direction.

A disk-shaped inner element 5 is arranged for relative axial displacement in a bore 4 of the housing 3. A lost motion spring means 16 is clamped between a cam-side front end 14*a* of the inner element 5 and an underside 14 of the housing 3. A cam-distal front end 6 of the inner element 5 serves as at least an indirect support for at least one gas exchange valve. The aforesaid space (hollow space 15) for the lost motion spring means 16 is free of further components.

As a person skilled in the art will further recognize from the drawing, a separate annular member 13 is inserted into a cam-distal region of the bore 4. This annular member 13 comprises two diametrically opposing windows as entraining surfaces 12 for coupling elements 8.

The inner element 5 possesses a radial bore 7 wherein two pistons as coupling elements 8 are situated diametrically opposite each other. These coupling elements 8 are loaded radially outwards (coupling direction), see FIG. 1, through the force of a compression spring 10*a* acting against their inner front ends 10. The pistons as coupling elements 8 comprise on their upper sides 23, a flattened portion 25 starting from their outer front ends 24. As shown in FIG. 1, in the coupled mode, these flattened portions 25 engage a corresponding underside of the window-like entraining surface 12 in the annular member 13.

Figure 2:
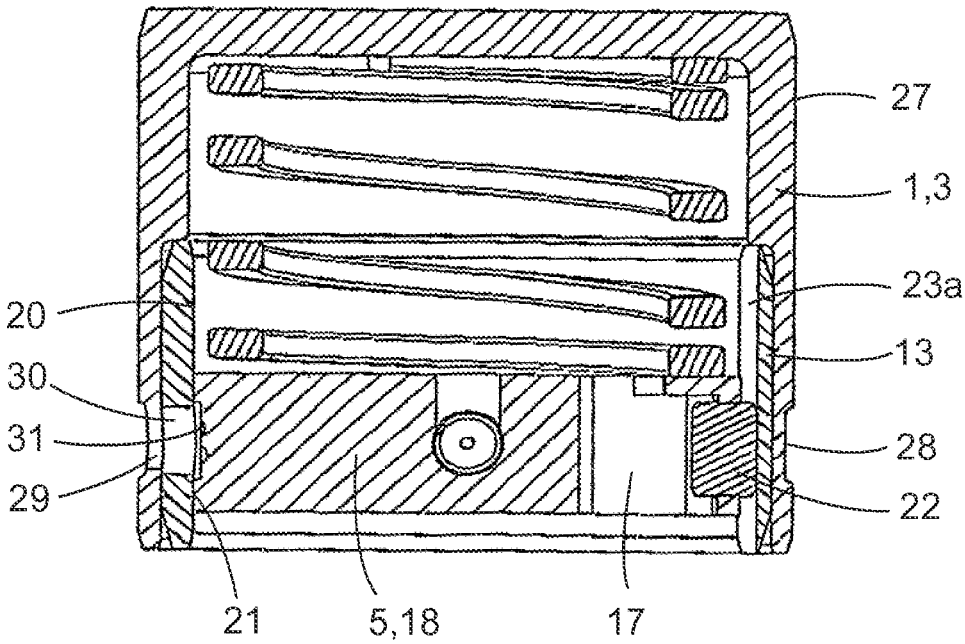
FIG. 2 shows a longitudinal section according to FIG. 1, but turned through 90°.

FIG. 2 discloses that an anti-rotation body 22 such as a pin is fixed in the outer peripheral surface 21 of the inner element 5 and extends partially in a longitudinal groove 23*a* in the inner peripheral surface 20 of the annular member 13. In this way, an exact positional relationship between the pistons as coupling elements 8 and their respective window-shaped apertures as entraining surfaces 12 is guaranteed at all times.

An opening 32 extends perpendicularly away from the center of the radial bore 7 in the inner element 5. This opening 32 serves to expel air during an uncoupling movement of the pistons as coupling elements 8.

Vertically, directly in front of the flattened portion 25 on each piston as a coupling element 8 extends an insert 27*a* (pin) as an anti-rotation device 26. This pin can be fixed through a simple interference fit in a corresponding recess of the inner element 5.

No anti-rotation body projects from the outer peripheral surface 27 of the housing 3. Thus, the tappet 1 can rotate freely relative to its surrounding structure. For the supply of hydraulic medium to the outer front ends 24 of the pistons as coupling elements 8, the outer peripheral surface 27 comprises an annular groove 28. As disclosed in FIG. 2, hydraulic medium can be conveyed from this annular groove 28 via a passage 29 in the housing 3 into a further passage 30 situated behind the passage 29 in the annular member 13 and then further into an annular groove 31 arranged in the outer peripheral surface 21 of the inner element 5. From there, the hydraulic medium is deflected so as to flow to a position directly in front of the outer front ends 24 of the pistons as coupling elements 8.

For reducing its mass, the inner element 5 comprises apertures 17 in the form of circular ring segments, so that radial connecting webs 18 are formed between these segments. During a sinking movement of the inner element 5 in case of uncoupling, air can also escape through these apertures 17 out of the hollow space 15 into the housing 3.

LIST OF REFERENCE NUMERALS

1 Tappet
2 Bottom
3 Housing
4 Bore
5 Inner element
6 Front end
7 Bore of inner element
8 Coupling element
9 Parting surface
10 Inner front end
10*a* Compression spring
11) not used
12 Entraining surface
13 Annular member
14 Underside
14*a* Front end
15 Hollow space
16 Lost motion spring means
17 Aperture
18 Connecting web
19 not used
20 Inner peripheral surface of annular member
21 Outer peripheral surface of inner element
22 Anti-rotation body

23 Upper side of coupling element
23*a*) Longitudinal groove
24 Outer front end
25 Flattened portion
26 Anti-rotation of coupling element
27 Outer peripheral surface of housing
27*a* Insert
28 Annular groove
29 Passage
30 Passage
31 Annular groove
32 Opening

The invention claimed is:

1. A switchable tappet of a valve train of an internal combustion engine, the tappet comprising:

a hollow cylindrical housing comprising a bottom;

an inner element constructed for relative axial displacement in a bore of the housing;

at least one indirect support for a gas exchange valve extending on a cam-distal front end of the inner element; and at least one coupling element constructed to selectively couple the inner element with the housing, wherein in an uncoupled mode the at least one coupling element extends completely in a radial bore of the inner element and wherein in a coupled mode the coupling element is displaced in a radially outward direction partly beyond a parting surface between the housing and the inner element into an entraining surface of the housing by the force of at least one compression spring acting on an inner front end of the coupling element;

wherein the entraining surface is a direct constituent of a separate annular member that is fixed in a cam-distal region of the bore of the housing, wherein a lost motion spring means extends in a cylindrical hollow space formed between an underside of the bottom of the housing and a cam-side flat front end of the inner element, and wherein the inner element is substantially disk-shaped and the parting surface between the housing and the inner element permits relative vertical movement of the inner element in the cam-distal direction in the uncoupled mode.

2. The tappet according to claim 1, wherein the inner element comprises, outside of a region of the bore, apertures configured as circular ring segments, wherein radial connecting webs are formed between apertures.

3. The tappet according to claim 1, wherein the tappet includes two coupling elements formed as pistons and wherein the radial bore of the inner element is constructed as one of a stepped or non-stepped through-bore, in which the pistons are diametrically opposed and extend completely in an uncoupled mode, and wherein the at least one compression spring is positioned between inner front ends of the pistons for biasing the pistons in the coupling direction, and the pistons are selectively displaced in the uncoupled mode by a hydraulic medium.

4. The tappet according to claim 3, wherein the entraining surface in the separate annular member constructed as at least one of an annular groove, an annular groove segment a window-shaped recess and a sickle-shaped recess in an inner peripheral surface of the annular member.

5. The tappet according to claim 3 wherein the entraining surface in the separate annular member is constructed as at least one of an annular groove segment or a window-shaped recess and a sickle-shaped recess in an inner peripheral surface of the annular member, and wherein the tappet further includes an anti-rotation body which projects from an outer peripheral surface of the inner element and extends in a longitudinal groove in the inner peripheral surface of the separate annular member, wherein the anti-rotation body is constructed as at least one of a pin and a ball.

6. The tappet according to claim 1, wherein each of the coupling elements comprises on an upper side thereof, a flattened portion extending inwardly from an outer front end, and wherein each of the coupling elements is constructed to be guided through an anti-rotation device disposed in the radial bore of the inner element.

7. The tappet according to claim 6, wherein at the flattened portion on each coupling element is positioned an insert which projects into the radial bore from a region of the cam-side flat front end of the inner element.

8. The tappet according to claim 5, wherein the tappet is constructed to rotate freely in a surrounding structure when the tappet is installed, and wherein an annular groove for routing a hydraulic medium is formed in the outer peripheral surface of the housing, wherein the hydraulic medium from the annular groove is constructed to be routed via passages situated adjacent to each other in the housing and in the separate annular member and routed into an annular groove formed in the outer peripheral surface of the inner element to a position directly in front of outer front ends of the two pistons, and the passages extend in a direction traverse to the direction of the radial bore.

9. The tappet according to claim 1, wherein at least one opening for expelling air out of the radial bore of the inner element is arranged formed in a central position in the inner element.

10. The tappet according to claim 1, wherein the separate annular member is fixed in the bore of the housing by at least one of pressing, welding, gluing and snapping.

11. A switchable tappet, especially a cup tappet of a valve train of an internal combustion engine, said tappet comprising:

a hollow cylindrical housing comprising a bottom;

an inner element being guided for relative axial displacement in a bore of the housing;

an at least indirect support for a gas exchange valve extending on a cam-distal front end of the inner element; and at least one coupling element extending completely in an uncoupled mode in a radial bore of the inner element, which coupling element, for effecting coupling, can be displaced partly beyond a parting surface between the housing and the inner element into an entraining surface of the housing by the force of at least one compression spring acting on an inner front end of the coupling element, wherein the entraining surface is a direct constituent of a separate annular member that is fixed in a cam-distal region of the bore of the housing, wherein only one compression spring/only one stack of compression springs as a lost motion spring means extends in a cylindrical hollow space formed between an underside of the bottom of the housing and a cam-side flat front end of the inner element, and wherein the inner element is substantially disk-shaped and the parting surface between the housing and the inner element does not comprise any vertical stop means, wherein as viewed in peripheral direction, the inner element comprises, outside of a region of the bore, apertures configured as circular ring segments, so that radial connecting webs are formed between said apertures.

12. A switchable tappet, especially a cup tappet of a valve train of an internal combustion engine, said tappet comprising:

a hollow cylindrical housing comprising a bottom;

an inner element being guided for relative axial displacement in a bore of the housing;

an at least indirect support for a gas exchange valve extending on a cam-distal front end of the inner element; and at least one coupling element extending completely in an uncoupled mode in a radial bore of the inner element, which coupling element, for effecting coupling, can be displaced partly beyond a parting surface between the housing and the inner element into an entraining surface of the housing by the force of at least one compression spring acting on an inner front end of the coupling element, wherein the entraining surface is a direct constituent of a separate annular member that is fixed in a cam-distal region of the bore of the housing, wherein only one compression spring/only one stack of compression springs as a lost motion spring means extends in a cylindrical hollow space formed between an underside of the bottom of the housing and a cam-side flat front end of the inner element, and wherein the inner element is substantially disk-shaped and the parting surface between the housing and the inner element does not comprise any vertical stop means, wherein the coupling elements comprise on an upper side, a flattened portion starting from an outer front end, and each of the coupling elements is guided through an anti-rotation device in the radial bore of the inner element.

13. The tappet according to claim 12, wherein vertically, directly on or in front the flattened portion on each coupling element is positioned an insert such as a pin as an anti-rotation device that projects from a region of the upper front end of the inner element through into the radial bore.

14. A switchable tappet, especially a cup tappet of a valve train of an internal combustion engine, said tappet comprising:

a hollow cylindrical housing comprising a bottom;

an inner element being guided for relative axial displacement in a bore of the housing;

an at least indirect support for a gas exchange valve extending on a cam-distal front end of the inner element; and at least one coupling element extending completely in an uncoupled mode in a radial bore of the inner element, which coupling element, for effecting coupling, can be displaced partly beyond a parting surface between the housing and the inner element into an entraining surface of the housing by the force of at least one compression spring acting on an inner front end of the coupling element, wherein the entraining surface is an direct constituent of a separate annular member that is fixed in a cam-distal region of the bore of the housing, wherein only one compression spring/only one stack of compression springs as a lost motion spring means extends in a cylindrical hollow space formed between an underside of the bottom of the housing and a cam-side flat front end of the inner element, and wherein the inner element is substantially disk-shaped and the parting surface between the housing and the inner element does not comprise any vertical stop means, wherein the radial bore of the inner element is configured as a stepped or non-stepped through-bore, in which two diametrically opposing pistons as coupling elements extend completely in an uncoupled mode, the at least one compression spring is clamped between inner front ends of the coupling elements for loading the coupling elements in coupling direction, and the pistons as coupling elements can be loaded in uncoupling direction by hydraulic medium, wherein the entraining surface in the separate annular member is configured as one of a) an annular groove, b) an annular groove segment or c) a window-shaped or sickle-shaped recess in an inner peripheral surface of the annular member, and wherein the coupling elements comprise on an upper side, a flattened portion starting from an outer front end and each of the coupling elements is guided through an anti-rotation device in the radial bore of the inner element.

15. The tappet according to claim 14, wherein vertically, directly on or in front the flattened portion on each coupling element is positioned an insert such as a pin as an anti-rotation device that projects from a region of the upper front end of the inner element through into the radial bore.

16. A switchable tappet, especially a cup tappet of a valve train of an internal combustion engine, said tappet comprising:

a hollow cylindrical housing comprising a bottom;

an inner element being guided for relative axial displacement in a bore of the housing;

an at least indirect support for a gas exchange valve extending on a cam-distal front end of the inner element; and at least one coupling element extending completely in an uncoupled mode in a radial bore of the inner element, which coupling element, for effecting coupling, can be displaced partly beyond a parting surface between the housing and the inner element into an entraining surface of the housing by the force of at least one compression spring acting on an inner front end of the coupling element, wherein the entraining surface is an direct constituent of a separate annular member that is fixed in a cam-distal region of the bore of the housing, wherein only one compression spring/only one stack of compression springs as a lost motion spring means extends in a cylindrical hollow space formed between an underside of the bottom of the housing and a cam-side flat front end of the inner element, and wherein the inner element is substantially disk-shaped and the parting surface between the housing and the inner element does not comprise any vertical stop means, wherein the radial bore of the inner element is configured as a stepped or non-stepped through-bore, in which two diametrically opposing pistons as coupling elements extend completely in an uncoupled mode, the at least one compression spring is clamped between inner front ends of the coupling elements for loading the coupling elements in coupling direction, and the pistons as coupling elements can be loaded in uncoupling direction by hydraulic medium, and wherein the entraining surface in the separate annular member is configured as one of a) an annular groove, b) an annular groove segment or c) a window-shaped or sickle-shaped recess in an inner peripheral surface of the annular member, and wherein for one of variants b) or c), an anti-rotation body configured as one of a pin or a ball projects from an outer peripheral surface of the inner element and extends in a longitudinal groove in the inner peripheral surface of the separate annular member, and wherein the tappet can be installed for rotating freely in a surrounding structure, an annular groove for hydraulic medium extends in the outer peripheral surface of the housing, hydraulic medium from this annular groove can be routed via passages situated behind each other in the housing and in the separate annular member into an annular groove in the outer peripheral surface of the inner element to a position directly in front of outer front ends of the two pistons as coupling elements, and the passages are arranged offset at 90° in peripheral direction to the radial bore in the inner element.

* * * * *